US008194413B2

(12) United States Patent
Osawa et al.

(10) Patent No.: US 8,194,413 B2
(45) Date of Patent: Jun. 5, 2012

(54) HEAD SUBSTRATE AND THERMAL HEAD SUBSTRATE

(75) Inventors: Kohei Osawa, Nagano (JP); Satoshi Nakajima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 525 days.

(21) Appl. No.: 12/399,363

(22) Filed: Mar. 6, 2009

(65) Prior Publication Data

US 2009/0231821 A1 Sep. 17, 2009

(30) Foreign Application Priority Data

Mar. 7, 2008 (JP) ..... 2008-057399

(51) Int. Cl.
*H05K 7/10* (2006.01)

(52) U.S. Cl. ..... 361/767; 361/760

(58) Field of Classification Search ..... 361/767, 361/760, 772, 768; 174/261, 260, 255; 347/237, 347/247, 209; 257/355, 360, 660, 608
See application file for complete search history.

(56) References Cited

U.S. PATENT DOCUMENTS

| | | | | |
|---|---|---|---|---|
| 6,392,685 | B1 * | 5/2002 | Nagahata et al. | 347/237 |
| 6,972,966 | B1 * | 12/2005 | Oishi et al. | 361/803 |
| 2001/0009435 | A1 | 7/2001 | Nagumo | |

FOREIGN PATENT DOCUMENTS

| | | | |
|---|---|---|---|
| EP | 1 057 650 | A1 | 12/2000 |
| JP | 57-008179 | A | 1/1982 |
| JP | 57-008179 | A | 1/1982 |
| JP | 03-230964 | A | 10/1991 |
| JP | 05-063022 | | 3/1993 |
| JP | 06-171133 | A | 6/1994 |
| JP | 7081114 | | 3/1995 |
| JP | 2001301211 | | 10/2001 |
| JP | 2005063022 | | 3/2005 |
| JP | 5-177863 | | 7/2005 |

OTHER PUBLICATIONS

European Search Report issued Jun. 17, 2009, in the corresponding EP Application 09003339.

* cited by examiner

*Primary Examiner* — Yuriy Semenenko
(74) *Attorney, Agent, or Firm* — Nutter McClennen & Fish LLP; John J. Penny, V

(57) ABSTRACT

A head substrate for mounting a driver IC that selectively drives a plurality of driving elements is provided. An input signal wiring pattern electrically connects external connection terminals with the pads in a first pad array and a second pad array. The input signal wiring pattern includes a clock signal line for supplying the clock signal to the driver IC and a logic power line for supplying the logic power to the driver IC. A part of the clock signal line and a part of the logic power line are disposed between the first pad array and the second pad array.

11 Claims, 11 Drawing Sheets

HEAD SUBSTRATE AND THERMAL HEAD SUBSTRATE

Priority is claimed to Japanese Patent Application No. 2008-057399 filed Mar. 7, 2008, the disclosure of which, including the specification, drawings and claims, is incorporated herein by reference in its entirety.

BACKGROUND

The present invention relates to a head substrate provided with a driver IC which selectively drives a plurality of driving elements.

As an example of an electronic device, a thermal printer is known. The thermal printer includes a thermal head where heater elements are disposed in a straight line. The heater elements disposed on the thermal head are selectively heated by being energized. The thermal energy corresponds selectively to a color fixing agent included in a thermal paper, so that a variety of information is printed on the thermal paper. The printing scheme is known as thermal coloring scheme.

Such thermal head includes a long rectangular thermal head substrate (substrate), plural heater elements (heating resistor) that are disposed on one end of a longitudinal side of the substrate along the longitudinal side, and driver ICs that are disposed in parallel to the plural heater elements and selectively drives the heater elements. On the thermal head substrate, an output signal wiring pattern is formed between the heater elements and the driver ICs so as to connect each other, and an input signal wiring pattern for the driver ICs is formed on a side facing the heater elements with the driver ICs being interposed therebetween.

The heater element is electrically conducted to a separate electrode and a common electrode, and the separate electrode is connected to an output pad of the driver IC via the output signal wiring pattern by using a wire bonding, etc. The driver IC turns on a predetermined output pad according to print data inputted via the input signal wiring pattern. A current flows between the separate electrode and the common electrode that correspond to the turned-on output pad, and thus a predetermined heater element is driven (for example, see Patent Document 1). Further, the driver IC that drives the predetermined heater element includes a control circuit including shift registers and latch circuits as a single IC chip (for example, see Patent Document 2). Further, it is also disclosed that the input signal wiring pattern, which can be simplified and where a width of the pattern which can be widened, is also provided on a mounting region of the driver IC (for example, see Patent Document 3).

Patent Document 1: Japanese Patent Publication No. 07-081114A

Patent Document 2: Japanese Patent Publication No. 2001-301211A

Patent Document 3: Japanese Patent Publication No. 05-063022A

The driver IC mounted on the above-mentioned thermal head substrate, for example, lets a current flow into the separate electrodes that correspond to the heater elements for 128 bits per one driver IC. For example, when the thermal head substrate includes 512 heater elements, four driver ICs are arranged. Therefore, 128×4 separate electrode patterns are formed on the thermal head substrate, and the common electrode pattern or the input signal wiring pattern including a ground line, a clock signal line, a logic power line, a latch signal line, and a strobe signal line is formed. For this reason, a layout of the pattern is complicated, and an area for forming the pattern is increased. As a result, an area of the thermal head substrate is increased, and thus the physical size of the thermal head is also increased. That is, it is difficult to achieve miniaturization of the thermal head and a cost reduction corresponding thereto. Patent Document 3 provides a countermeasure to this difficulty. However, in this case, the clock signal line and the latch signal line are disposed on the mounting region of the driver IC, where the high-frequency clock signal noise affects other portions, especially output lines of head driving signals, which causes an error.

SUMMARY

It is therefore an object of at least one embodiment of the invention to provide a head substrate with high reliability, which is minimally affected by a clock signal line noise.

According to an aspect of at least one embodiment of the invention, there is provided a head substrate on which a driver IC is to be mounted, the driver IC selectively driving a plurality of driving elements, the head substrate comprising: a plurality of external connection terminals including a plurality of contacts to which a clock signal and logic power for the driver IC are supplied; a first pad array including a plurality of pads formed at one side in a region on which the driver IC is mounted, the pads including output pads which is to be connected to terminals provided on the driver IC and outputs driving signals to the elements; a second pad array including a plurality of pads formed at another side in the region on which the driver IC is mounted, the pads including ground pads which is to be connected to terminals provided on the driver IC and grounds the driver IC; and an input signal wiring pattern electrically connecting the external connection terminals with the pads in the first pad array and the second pad array; wherein the input signal wiring pattern includes a clock signal line for supplying the clock signal to the driver IC and a logic power line for supplying the logic power to the driver IC; wherein a part of the clock signal line and a part of the logic power line are disposed between the first pad array and the second pad array.

According to the above-mentioned configuration, it is possible to provide at least a part of the clock signal line and the logic power line in the region on which the driver IC is to be mounted, that is, in the region corresponding to an area of a bottom surface of the driver IC. Therefore, it is possible to reduce the number of lines in the input signal wiring pattern which is provided between the driver IC and the external connection terminals. As a result, an area occupied by the input signal wiring pattern can be reduced, and it can contribute to miniaturization of the head substrate. Further, the logic power line of a constant voltage is adjacent to the clock line which tends to generate a noise. Since the logic power line of the constant voltage is unsusceptible to the noise, a bad effect due to the noise of the clock signal line with respect to the other components can be effectively suppressed. In addition, if the clock signal of the clock signal line resonates with a signal of a signal like which is adjacent to the clock signal line, a large disturbance may affect the other components, especially, the head driving signals of the output lines. However, since the clock signal of the clock signal like does not resonates with the constant voltage of the logic power line, there is no effect due to the resonance with respect to the other components.

The logic power line may be disposed between the first pad array and the clock signal line.

According to the above-mentioned configuration, the logic power line which is not affected by noise is provided between the first input-output pad array which is easily affected by noise and the clock signal line where noise easily occurs.

Therefore, since the noise from the clock signal line is absorbed by the logic power line, the effect of noise on the first input-output pad array is extremely reduced.

The driving elements may be formed on the substrate in a row; and a plurality of driver ICs can be mounted on the head substrate in parallel with the driving elements.

According to the above-mentioned configuration, a part of the clock signal line and the logic power line is provided as a signal line which is continuously provided so as to pass through areas of bottom surfaces of the plurality of driver ICs. Then, it is possible to supply signals to each driver IC. For this reason, the number of the input signal wiring patterns is not extremely increased even though the number of driver ICs is increased, and thus an area occupied by the input signal wiring patterns can be reduced, and it can contribute to downsizing of the head substrate.

The external connection terminals may include a contact to which one of a latch signal and a strobe signal is supplied; the pads in the first pad array and the second pad array may include a first input pad at one side of a region on which one of the driver ICs is mounted and an output pad at another side of the region and a second input pad at one side of a region on which another of the driver ICs is mounted; and the input signal wiring pattern may electrically connect the contact with the first input pad and connect the output pad with the second input pad.

According to the above-mentioned configuration, the latch signal or the strobe signal can be supplied through plural driver ICs. For this reason, the number of the input signals can be reduced, and thus an area occupied by the input signal wiring patterns can be reduced. As a result, it can contribute to miniaturization of the head substrate.

At least one of the first pad array and the second pad array may include a first extension pad which is to be connected to a first terminal provided on the driver IC and a second extension pad which is to be connected to a second terminal provided on the driver IC when the first terminal and the second terminal are electrically connected with each other; and the first extension pad and the second extension pad may be extended to the outside of the region on which the driver IC is mounted.

According to the above-mentioned configuration, since a resistance value between the first and the second extension pads can be measured by using a resistance measuring equipment, or a current voltage characteristic can be measured by a current flowing between the pads, a connection state between the substrate and the driver IC can be detected. That is, if the resistance value between the first extension pad and the second extension pad is close to zero, it is determined that the driver IC is mounted on the substrate in a normal electrical conduction state. If the resistance value is higher than it is expected to be, it is determined that it is a contact fault by a soldering error. In this configuration, when the driver IC is bonded to the substrate via an ACF therebetween by using a flip chip bonding method, it is preferable because it can be checked and managed whether or not the ACF is properly pressed and normally electrically conducted.

The input signal wiring pattern may electrically connect the second extension pad with one of the external connection terminals.

According to the above-mentioned configuration, it is possible to connect the external connection terminals with the first pad array by passing above the signal lines which are disposed between the first pad array and the second pad array of the substrate. Therefore, it can contribute to simplification of the wiring pattern.

The head substrate may further comprise an input pad which is disposed between the first pad array and the second pad array and is to be connected to a terminal provided on the driver IC, the clock signal line electrically may connect the input pad to one of the contacts to which the clock signal for the driver IC is supplied.

The head substrate may further comprise an input pad which is disposed between the first pad array and the second pad array and is to be connected to a terminal provided on the driver IC, the logic power line electrically may connect the input pad with one of the contacts to which the logic power for the driver IC is supplied.

According to the above-mentioned configuration, the input pads of the logic power line and the clock signal line can be formed on the signal pattern which is disposed between the first pad array and the second pad array. For this reason, it is possible to simplify the patterns of the logic power line and the clock signal line, and thus it can contribute to reduce the electrical effect of noise.

A plurality of driver ICs can be mounted on the head substrate in parallel with the driving elements; the head substrate may further comprise a first input pad which is to be connected to a terminal provided on one of the driver ICs and a second input pad which are to be connected to a terminal provided on another of the driver ICs; the first input pad and the second input pad may be disposed between the first pad array and the second pad array; the external connection terminals may include a first contact and a second contact to which the logic power for the driver IC is supplied; the logic power line may include a first logic power line and a second power line; and the first logic power line may electrically connect the first input pad with the first contact and the second logic power line may electrically connect the second input pad with the second contact.

According to the above-mentioned configuration, the logic power is supplied to the driver ICs with the plural wiring patterns. Therefore, compared with the case where plural driver ICs are connected to a power pattern in serial from just one direction, it is possible to reduce a loss in resistance of the wiring pattern, and thus it can contribute to supplying a stable power having low voltage drop to the driver IC.

According to another aspect of at least one embodiment of the invention, there is provided a method for mounting a driver IC on a head substrate, comprising: providing the above mentioned head substrate; and mounting the driver IC on the head substrate via an anisotropic conductive film by a flip chip bonding method.

According to the above-mentioned method, it is possible to miniaturize the head substrate and the cost can be reduced.

According to still another aspect of at least one embodiment of the invention, there is provided a thermal head substrate, comprising: a wiring pattern which is formed on the substrate from a plurality of heater elements disposed in a row in the vicinity of one long side of the substrate which is formed into a rectangle shape to a mounting region of a plurality of driver ICs which selectively heats the heater elements; and a signal wiring pattern formed on the substrate to make a conduction between an external connection terminal portion formed at another long side of the substrate and input and output portion for a control signal of the driver ICs and make a signal connection between the driver ICs; wherein pads are formed in a row in the mounting region of the driver ICs at a side of the heater elements, the pads including an output pad of a plurality of heater driving signals, which is connected to a terminal provided in the driver ICs; wherein pads are formed in a row at a side of the external connection terminal portion, the pad including a plurality of ground pads which are electrically connected to the signal wiring pattern and connected to a terminal formed in the driver ICs; and wherein at least a clock signal line and a logic power line are formed between a pad row including the output pad of the heater driving signals and a pad row including the ground pads.

BRIEF DESCRIPTION OF THE DRAWINGS

The above objects and advantages of the present invention will become more apparent by describing in detail preferred exemplary embodiments thereof with reference to the accompanying drawings, wherein:

FIG. 4(*b*) is an enlarged view illustrating a part of the thermal head a substrate shown in FIG. 4(*a*);

DETAILED DESCRIPTION OF THE EMBODIMENTS

Hereinafter, pointing to a thermal printer mounted on an electronic device as an example, embodiments of the present invention are described with reference to the accompanying drawings. In addition, for convenience of explanation and illustration, the dimensions in both longitudinal and lateral direction of members or portions may be expressed differently from actual dimensions.

First Embodiment

Thermal Head

Figure 1:
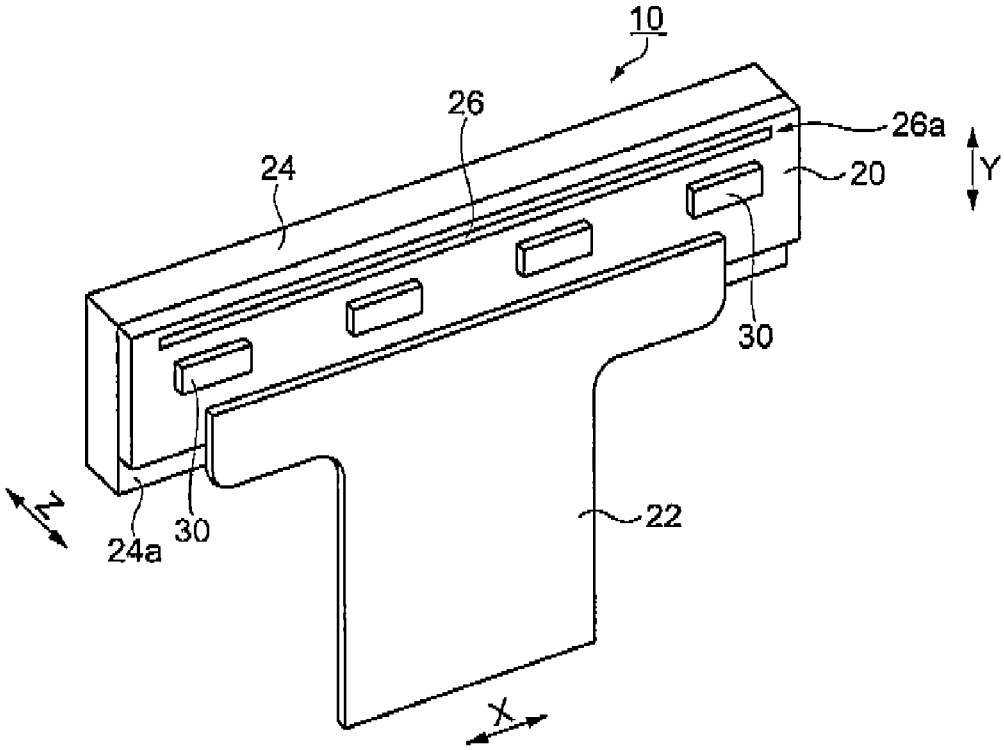
FIG. 1 is an external perspective view illustrating a thermal head according to a first embodiment of the present invention.

The thermal head according to a first embodiment is described with reference to FIG. 1. In FIG. 1, an X direction indicates a width direction of a thermal paper to be printed when a thermal head is adapted to a thermal printer, a Y direction indicates a feeding direction of the thermal paper in the thermal head portion, and a Z direction indicates a direction perpendicular to the X and Y directions.

As shown in FIG. 1, the thermal head 10 includes a thermal head substrate 20, a driver IC 30, a Flexible Print Circuit (FPC) 22, and a heatsink 24. The thermal head substrate 20 is formed in a long rectangular plate shape that is made of an insulating material, and a heater element array 26*a* that is provided with plural heater elements 26 is formed in a position close to one end of longitudinal sides of the thermal head substrate 20. The driver IC 30 is formed such that a control circuit selectively driving the heater element 26 is configured as discrete IC chips, and is disposed on the thermal head substrate 20 in a row in parallel to the heater element array 26*a*.

Figure 4:
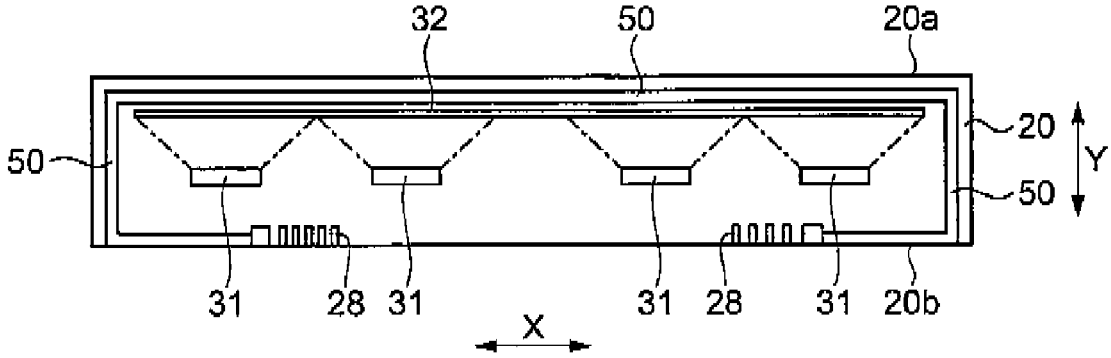
FIG. 4(*a*) is a diagram illustrating the entire thermal head substrate.
Figure 4:
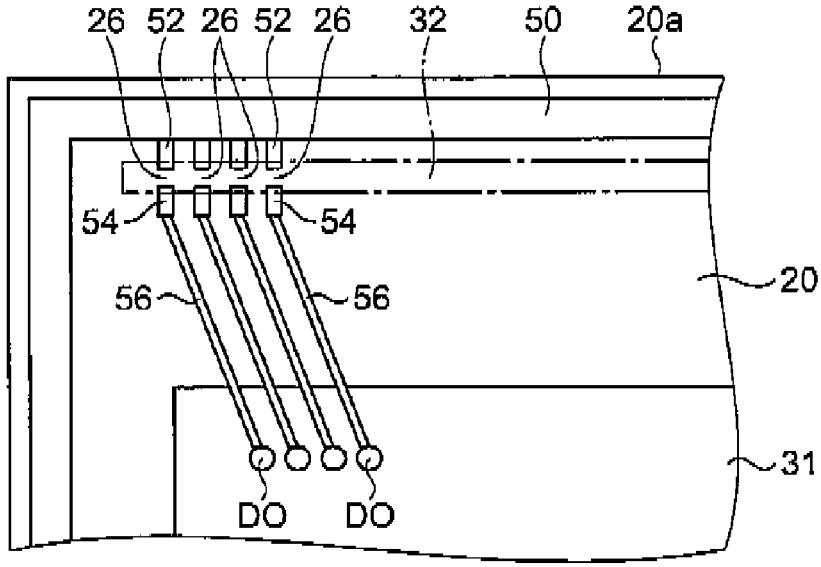

One end of the FPC 22 is connected to a connecting terminal 28 (refer to FIG. 4(*a*)) that is provided on the thermal head substrate 20, and the other end thereof is connected to a control unit that controls the thermal printer (not shown). The heatsink 24 is formed into a long rectangular shape and is made of an extruded material such as aluminum. The thermal head substrate 20 is bonded to a holding surface 24*a* of the heatsink 24 by using an adhesive or the equivalent thereof.

The thermal head 10 is applicable to, for example, a thermal printer for a Point of Sale (POS) system which prints and issues receipts or coupons. The thermal printer includes the thermal head 10 and a platen that comes in pressing contact with the thermal head 10 by the press structure, and transports the thermal paper having a color-producing layer that is interposed between the thermal head 10 and the platen while selectively heating the heater element 26. At this time, a color fixing agent of the thermal paper reacts to thermal energy and a printing is performed.

(Control of Thermal Head)

A control of the thermal head is described with reference to FIGS. 2 and 3. The control of the thermal head is performed by the control unit of the above-mentioned thermal printer.

Figure 2:
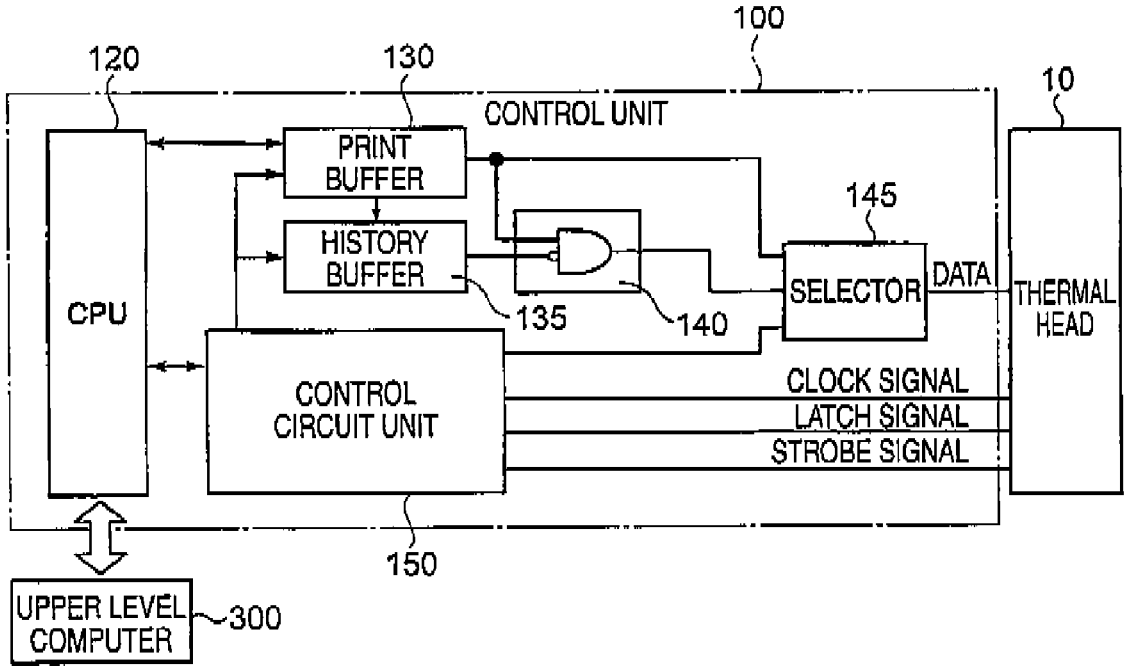
FIG. 2 is a block diagram illustrating a control unit of the thermal head.

As shown in FIG. 2, a control unit 100 of the thermal head 10 includes a CPU 120, a print buffer 130, a history buffer 135, a logic circuit 140, a selector 145, and a control circuit unit 150. The CPU 120 is connected to an upper-level computer 300, which is included in the POS system or the like. The upper-level computer 300 delivers control information such as print data or control data to the CPU 120. The CPU 120 processes various detection signals inputted, commands, data and the like according to a control program, and outputs various control signals to the control circuit unit 150 etc., thereby controlling the printing operation of the thermal head 10.

First, print pixel data for one dot-line sent from the CPU 120 is stored in the print buffer 130 and is sent to the thermal head 10 through the selector 145. When the print pixel data for next dot-line is stored in the print buffer 130 prior to storing the print pixel data, the previous data in the print buffer 130 is moved to the history buffer 135. The data stored in the history buffer 135 and the data stored in the print buffer 130 are calculated for each bit, that is, each of the heater elements 26, by the logic circuit 140 and are outputted to the selector 145.

The selector 145 is a type of sequencer that sequentially outputs the data from the print buffer 130 and the data from the logic circuit 140 by a data selector signal sent from the control circuit unit 150. That is, an energizing period is divided into a portion that corresponds to the data from the print buffer 130 (Period 1) and a portion that corresponds to the data from the logic circuit 140 (Period 2). In Period 1, the data from the print buffer 130 is outputted and in Period 2 the data from the logic circuit 140 is outputted by the data selector signal and the data is sent to the thermal head 10.

Next, a control of the heater element in the thermal head will be described with reference to FIG. 3. As described above, the thermal head 10 includes a number of heater elements 26 that are formed on the thermal head substrate 20 to be used for simultaneously printing the print pixel data for one dot-line and the driver IC 30, which is mounted on the thermal head substrate 20.

Figure 3:
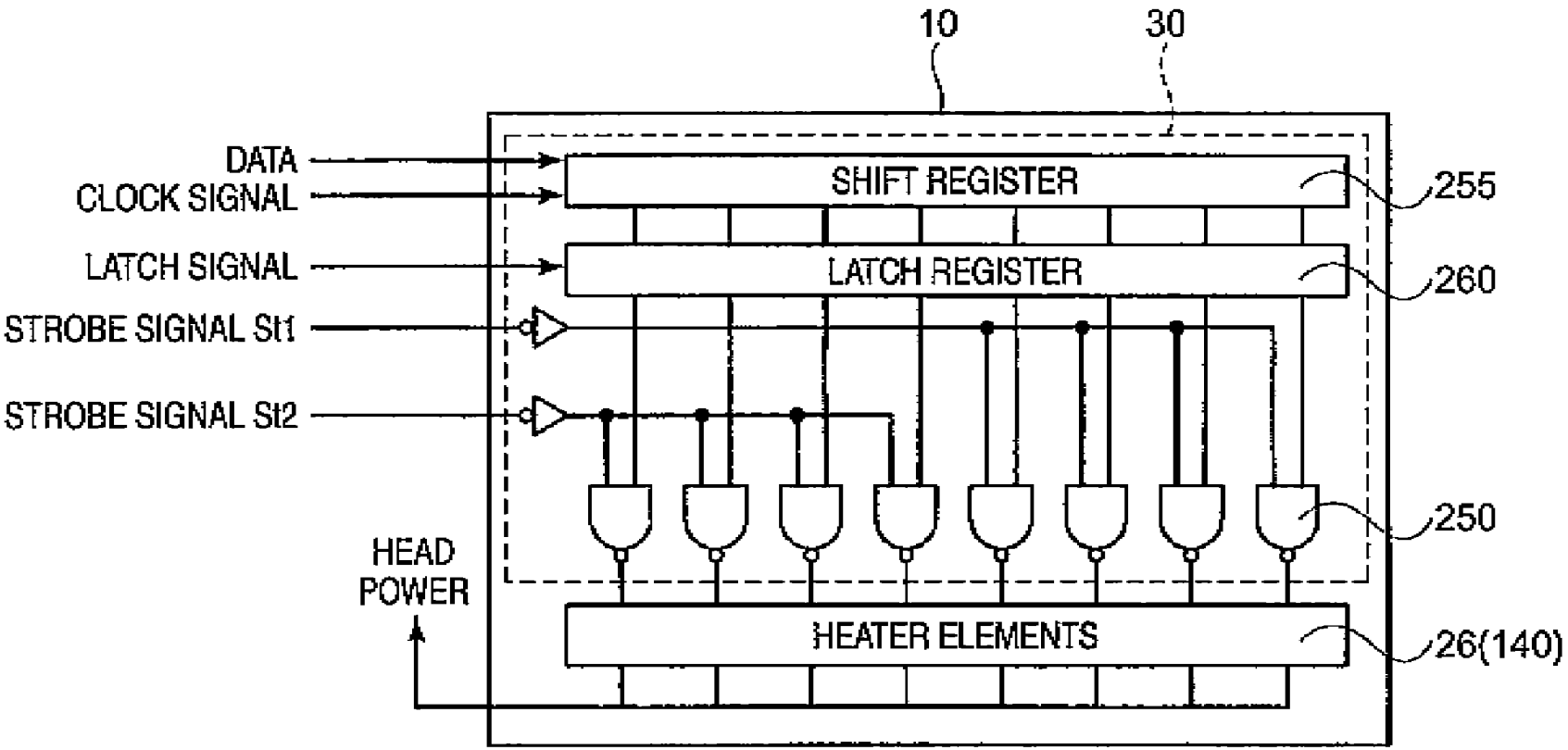
FIG. 3 is a block diagram illustrating the thermal head.

As shown in FIG. 3, the driver IC 30 includes plural drive circuits 250 that independently drive the heater elements 26, shift resisters 255 that temporarily store the print pixel data for one dot-line, and latch registers 260. Each drive circuit 250 includes a PNP transistor. By selectively driving the drive circuits 250, a corresponding heater element 26 is selectively heated, and thus a corresponding position on the thermal paper is colored.

The drive circuit 250 is illustrated as a NAND circuit is to show a logical operation of the corresponding circuit. That is, when a strobe signal is in a non-active (High level) state, the drive circuit 250 is de-selected. An equivalent circuit can be realized by connecting a data signal and a strobe signal (positive logic) with a wired OR circuit configuration to a base of the PNP transistor.

The drive circuit 250 receives an inversion signal (positive logic) of two strobe signals St1 and St2 generated by a delay circuit (not shown) and data (positive logic) outputted from the latch register 260, and is driven according to levels of both signals. That is, when data of "1," which means "printing" as the print pixel data is given, and the strobe signal transitions to "Low" from "High", that is, if the strobe signal changes effectively, the drive circuit 250 provided with the NAND circuit outputs "Low".

Therefore, a potential difference between the head power voltage and the output of the drive circuit 250 occurs in a corresponding heater element 26 that is caused to be heated, and a corresponding area of the thermal paper is colored by the thermal energy. The strobe signal is supplied as signals divided into three or four that are different from each other in a pulse width. In addition, two strobe signals /St1 and /St2 can be applied by shifting an output timing thereof by the delay circuit. Therefore, it is possible to avoid a problem of a voltage drop in a power supply, which occurs when a number of drive circuits 250 are simultaneously in the energization state.

The shift register 255 receives print pixel data for one dot-line that corresponds to a period in synchronization with a clock signal, and holds the print pixel. In addition, the print pixel data is data corresponding to each print pixel for one dot-line and, strictly speaking, the data indicates whether or not the heater elements 26 are energized in the period for one dot-line of the print pixel data. The print pixel data constitutes a bit string of "1" which means "energizing" and "0" which means "not energizing." In addition, data that is generated by a predetermined calculation for the current print pixel data and the past print pixel data is inputted into the shift register 255 in every predetermined energizing period.

The latch register 260 is connected to the shift register 255, and transports each bit data on the shift register 255 to corresponding storage areas in parallel simultaneously, respectively, to hold the data. Therefore, it is also possible to input the print pixel data corresponding to the next energizing period into the shift register 255 during an energizing period. Data transfer timing from the shift register 255 to the latch register 260 is controlled by input timing of a latch signal outputted from the control unit 100 to the latch register 260.

The data transfer timing comes after the previous energizing period and before the next energizing period, and it comes after the print pixel data corresponding to the next energizing period is set to the shift register 255. As described above, each storage area of the latch register 260 is connected to one of the input terminals of the drive circuit 250. When new data is received to the latch register 260 by the input of the latch signal, the input data to the drive circuit 250 is immediately changes according to the content. Each drive circuit 250 drives a corresponding heater element 26 in a period when a delayed strobe signal given is "Low" (active) according to the data of the latch register 260.

The thermal head 10 having the above-mentioned configuration selectively energizes a selected number of the heater elements 26 disposed on the thermal head 10 in a straight line based on the print pixel data while transporting the thermal paper that is interposed between the thermal head 10 and the platen. Therefore, it is possible to print pixels on the thermal paper by one dot-line.

(Thermal Head Substrate)

The thermal head substrate according to the first embodiment is described with reference to FIGS. 4(*a*), 4(*b*) and 5.

As shown in FIGS. 4(*a*) and 4(*b*), the thermal head substrate 20 is made of insulating materials such as alumina ceramic, and is formed in a long rectangular shape. The thermal head substrate 20 is provided with a heating body 32 close to one longitudinal side 20*a* along a longitudinal direction. The heating body 32 converts an energizing current into heat. On the other longitudinal side 20*b* of the thermal head substrate 20, plural connection terminals 28 used as an external connection terminal are provided in a row so as to be electrically connected to the outside.

IC mounting portions 31 are provided between the heating body 32 and the plural connection terminals 28 of the thermal head substrate 20 for each driver IC 30 that selectively drives the heater elements 26. The IC mounting portions 31 are formed in a row in parallel with the heating body 32 of a straight line shape. In the IC mounting portion 31, input-output pads are formed to correspond to the input-output terminals provided on a bottom surface of the driver IC 30 to be mounted.

In a strip-line shape area between the heating body 32 and one longitudinal side 20*a* of the thermal head substrate 20, a head power pattern 50 is formed. Both end parts of the head power pattern 50 are extended to reach the connection terminal 28 via both lateral sides of the thermal head substrate 20 to connect to the connection terminal 28 located at the both sides of the plural connection terminals 28.

As shown in FIG. 4(*b*), a common electrode 52 of a pectinate shape is extended to the heating body 32 from the head power pattern 50 to be face the common electrode 52 of the pectinate shape, so that separate electrodes 54 are formed. Output signal wiring patterns 56 are extended from the separate electrodes 54. The other ends of the output signal wiring patterns 56 are extended to the IC mounting portion 31, and the ends thereof are connected to output pads DO.

As described above, the heater elements 26 are defined by the common electrodes 52 and the separate electrodes 54 of the pectinate shape that face each other. That is, when the selected separate electrode 54 is driven to be ON, a current flows into the heating body 32 in a region that surrounds the separate electrode 54 and the common electrode 52, so that the portion serves as the heater element 26.

Figure 5:
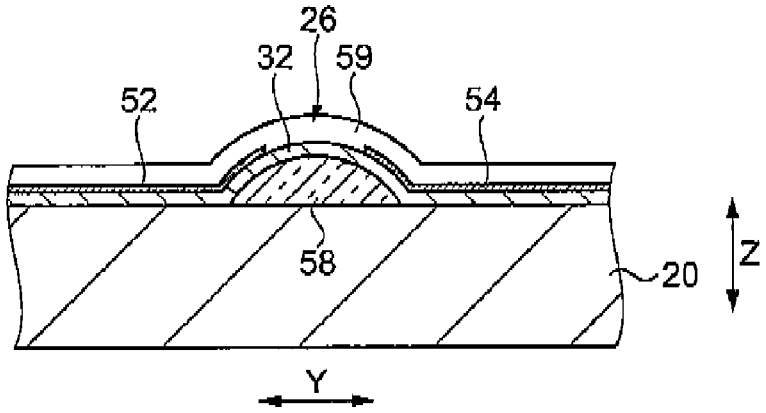
FIG. 5 is a cross-sectional view illustrating a heater element of the thermal head substrate.

Here, the heater element 26 is described in detail with reference to FIG. 5. As shown in FIG. 5, glaze layers 58 having a semi-circular arc shape as viewed in a cross-sectional direction which are extended as a strip-like shape in a longitudinal side direction of the thermal head substrate 20 are formed on the thermal head substrate 20. The glaze layer 58, for example is made of glass or the like, and accumulates heat generated from the heater element 26 to maintain a good thermal responsiveness of the thermal head 10. Further, the glaze layer 58 forms a convex shape to face the thermal paper, so as to assist in securing a contact state between the heater element 26 and the thermal paper. The heating body 32 is formed on the glaze layer 58. The heating body 32, for example, is provided with a resistive layer which is made of electrical resistive materials such as TaN-based, TaSiO-based, TaSiNO-based, TiSiO-based, TiSiCO-based, and NbSiO-based materials.

As described above, the common electrode 52 and the separate electrode 54 are formed on the heating body 32 so as to face to each other with a gap therebetween. A protective film 59 is coated on an upper surface of the heating body 32, the common electrode 52, and the separate electrode 54. The protective film 59 protects the heating body 32, the common electrode 52 and the separate electrode 54 from corrosion by moisture in the air or from abrasion by coming in slidable contact with a recording medium. The protective film 59 is formed with an inorganic material, such as SiC or SiN-based, SiO-based, SiON-based materials or the like, or glass so as to have a thickness of 3 μm to 10 μm. In addition, the protective film 59 is formed by a well-known thin-film formation technique, such as a sputtering method, a vapor deposition method, and a CVD method, or a thick-film formation technique such as a screen printing method and a dispenser method.

Input signal wiring patterns are formed between the connection terminal 28 and the IC mounting portion 31 of the thermal head substrate 20, and between the IC mounting portions 31 shown in FIG. 4(*a*) in order to provide electrical conduction between connection terminals 28 and input-output pads of the control signals of the driver IC 30 and to transmit signals between the driver ICs 30. In addition, a connector or a Flat Flexible Cable (FFC) is connected to the connection terminal 28 in addition to the FPC and the transmission and reception of control signals for controlling the thermal head 10 is performed.

Next, a layout pattern of the thermal head substrate is described in detail with reference to FIG. 6. The first embodiment is described with an example, where 512 heater elements are provided on the thermal head substrate and 4 driver ICs are used to let a current flow into the separate electrodes corresponding to the heater elements (128 elements or 128 bits per one driver IC).

Figure 6:
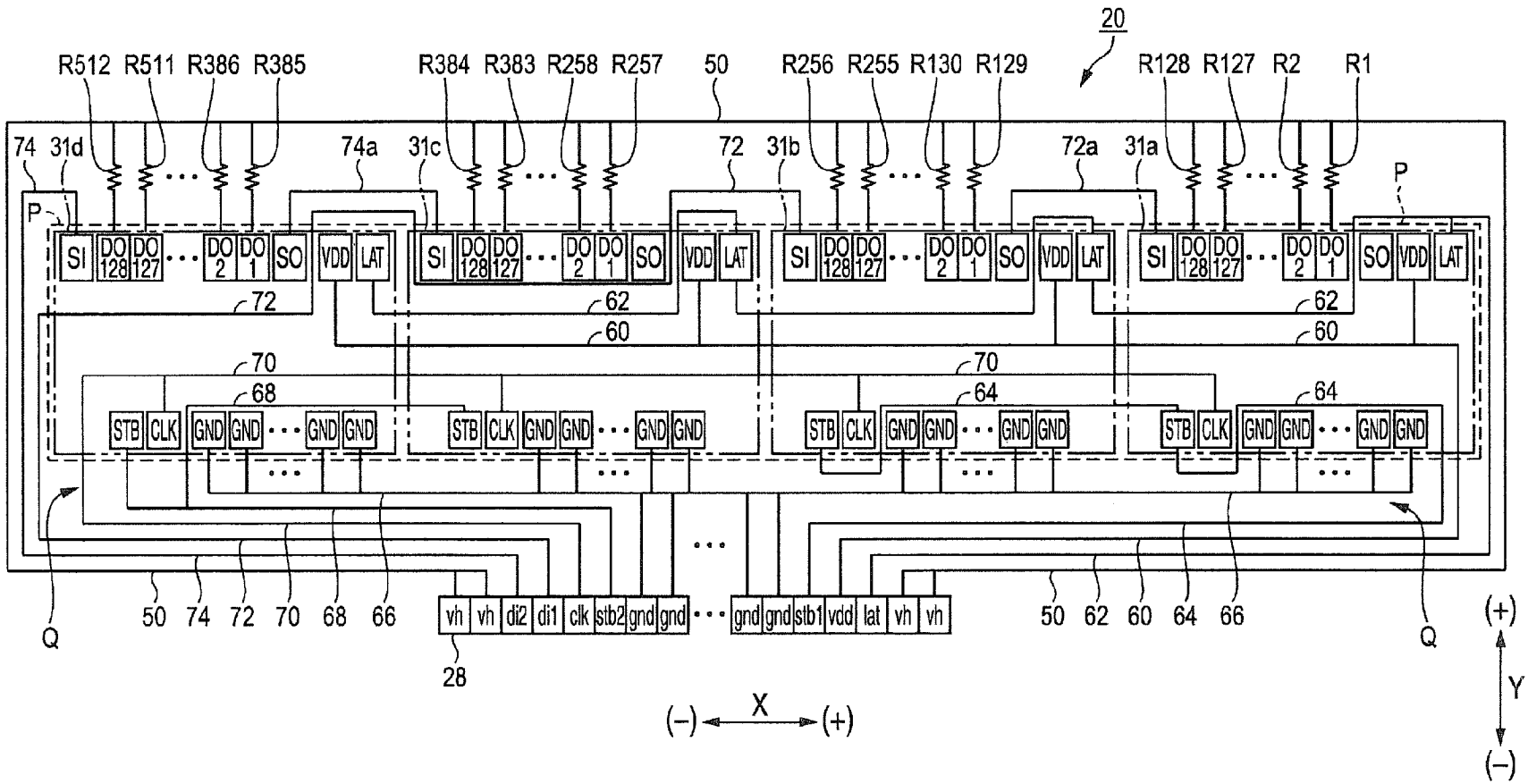
FIG. 6 is a diagram illustrating a pattern layout of the thermal head substrate.

As shown in FIG. 6, the patterns of the thermal head substrate 20 includes connections to 512 heater elements 26, 4 IC mounting portions 31 where 4 driver ICs 30 are to be mounted, and plural connection terminals 28. In addition, as is described later, 512 heater elements 26 are expressed as heater elements R1 to R512. The heater elements R1 to R512 include the common electrode 52, the separate electrode 54, and the output signal wiring pattern 56 shown in FIG. 4(*b*), respectively. Further, 4 IC mounting portions 31 are expressed as IC mounting portions 31*a*, 31*b*, 31*c*, and 31*d* in the order from the right of FIG. 6. When the specification refers to IC mounting portion 31, it refers to each of all IC mounting portions. In addition, references to a region P refers to a region that surrounds the IC mounting portions 31*a*, 31*b*, 31*c*, and 31*d* and references to a region Q refers to a region between the connection terminal 28 and the IC mounting portion 31.

As described above, the head power pattern 50 is formed on one longitudinal side of the thermal head substrate 20. Both end parts of the head power pattern 50 are extended to reach the connection terminal 28 to connect to a head power terminal vh located on both sides of the connection terminal 28.

A section of the connection terminal 28 is provided with the above-mentioned head power terminals vh, a latch terminal lat, a logic power terminal vdd, a first strobe terminal stb1, ground terminals gnd, a second strobe terminal stb2, a clock terminal clk, a first data terminal di1, a second data terminal di2, and the head power terminals vh in the order from the right of FIG. 6. In order to obtain an enough amount of current, two head power terminals vh are provided on both sides of the connection terminal 28, respectively, and six ground terminals gnd are provided in the center portion.

In the IC mounting portion 31, a latch pad LAT, a logic power pad VDD, a signal-out pad SO, output pads DO1 to DO128 that are electrically conducted to 128 heater elements 26, and a signal-in pad SI forms a row on the side of the heater elements R1 to R512 in an order from the right of FIG. 6 (a first pad array). In addition, in the IC mounting portion 31, five ground pads GND, a clock pad CLK, and a strobe pad STB forms a row on the side of the connection terminal 28 in the order from the right of FIG. 6 (a second pad array).

In the heater elements R1 to R128, the separate electrodes 54 are electrically conducted to the output pads DO1 to DO128 of the IC mounting portion 31*a*, respectively, and the common electrodes 52 are electrically conducted to the head power pattern 50. In the heater elements R129 to R256, the separate electrodes 54 are electrically conducted to the output pads DO1 to DO128 of the IC mounting portion 31*b*, respectively, and the common electrodes 52 are electrically conducted to the head power pattern 50.

In the heater elements R257 to R384, the separate electrodes 54 are electrically conducted to the output pads DO1 to DO128 of the IC mounting portion 31*c*, respectively, and the common electrodes 52 are electrically conducted to the head power pattern 50. In the heater elements R385 to R512, the separate electrodes 54 are electrically conducted to the output pads DO1 to DO128 of the IC mounting portion 31*d*, respectively, and the common electrodes 52 are electrically conducted to the head power pattern 50.

The logic power terminal vdd of the connection terminal 28 and the logic power pad VDD of the IC mounting portion 31 are electrically conducted by a logic power line to form a logic power pattern 60 formed. The logic power pattern 60 starts from the logic power terminal vdd, being extended in a (+) direction of X in a region Q of the thermal head substrate 20 shown in FIG. 6, being drawn up in a (+) direction of Y in the right side of the thermal head substrate 20 to enter into the IC mounting portion 31*a*, changing the direction in the IC mounting portion 31*a*, being further extended in the (−) direction of X to pass through the IC mounting portions 31*b* and 31*c*, and entering into the IC mounting portion 31*d*, to be electrically conducted to the logic power pad VDD of the IC mounting portion 31*d*. The logic power terminal vdd of the connection terminal 28 and the logic power pads VDD of the IC mounting portions 31*a*, 31*b*, and 31*c* are electrically conducted by being drawn up from the positions of the logic power pattern 60 corresponding to the logic power pads VDD in the region P in the (+) direction of Y.

The clock terminal clk of the connection terminal 28 and the clock pad CLK of the IC mounting portion 81 are electrically conducted by a clock signal line to form a clock signal pattern 70. The clock signal pattern 70 starts from the clock terminal clk, being extended in the (−) direction of X in the region Q of the thermal head substrate 20 shown in FIG. 6, being drawn up in the (+) direction of Y in the left side of the thermal head substrate 20, entering into the IC mounting portion 31*d*, changing the direction in the IC mounting portion 31*d*, being further extended in the (+) direction of X to pass through the IC mounting portions 31*c* and 31*b*, and entering into the IC mounting portion 31*a*, to be electrically conducted to the clock pad CLK of the IC mounting portion 31*a*. The clock terminal elk of the connection terminal 28 and the clock pad CLK of the IC mounting portions 31*b*, 31*c*, and 31*d* are electrically conducted by being drawn down from the positions of the clock signal pattern 70 corresponding to the clock pads CLK in the region P in a (−) direction of Y.

The ground terminal gnd of the connection terminal 28 and the ground pad GND of the IC mounting portion 31 are electrically conducted to form a ground pattern 66. The ground pattern 66 starts from the ground terminal gnd, being drawn up in the (+) direction of Y in the region Q of the thermal head substrate 20 shown in FIG. 6, being extended close to the IC mounting portions 31*a*, 31*b*, 31*c*, and 31*d*, and being extended in the (+) and (−) direction of X in the region Q. The ground pattern 66 which is extended in the (+) direction is formed to be electrically conducted to the ground pad GND of the IC mounting portion 31*a*, and the ground pattern 66 which is extended in the (−) direction of X is formed to be electrically conducted to the ground pad GND of the IC mounting portion 31*d*. The ground terminal gnd of the connection terminal 28 and the ground pad GND of the IC mounting portions 31*b* and 31*c* are electrically conducted by being drawn up from the positions of the ground pattern 66 corresponding to the ground pads GND in the region Q, respectively, in the (+) direction of Y.

The latch terminal lat of the connection terminal 28 and the latch pad LAT of the IC mounting portion 31 are electrically conducted to form a latch signal pattern 62. The first strobe terminal stb1 of the connection terminal 28 and the strobe pads STB of the IC mounting portion 31*a* and 31*b* are electrically conducted by a first strobe signal pattern 64. The second strobe terminal stb2 of the connection terminal 28 and the strobe pads STB of the IC mounting portions 31*c* and 31*d* are electrically conducted by a second strobe signal pattern 68.

A first data signal pattern 72 is extended from the first data terminal di1 of the connection terminal 28, and the first data signal pattern 72 is electrically conducted to the signal-in pad SI of the IC mounting portion 31*b*. The signal-out pad SO of the IC mounting portion 31*b* is electrically conducted to the signal-in pad SI of the IC mounting portion 31*a* to form a first data signal pattern 72*a*. A second data signal pattern 74 is extended from the second data terminal di2 of the connection terminal 28, and the second data signal pattern 74 is electrically conducted to the signal-in pad SI of the IC mounting portion 31*d*. The signal-out pad SO of the IC mounting portion 31*d* is electrically conducted to the signal-in pad SI of the IC mounting portion 31*c* to form a second data signal pattern 74*a*.

The latch signal pattern 62, the first strobe signal pattern 64, the second strobe signal pattern 68, the first data signal patterns 72 and 72*a*, and the second data signal patterns 74 and 74*a* are formed to take advantage of an empty space on the thermal head substrate 20 where the output signal wiring pattern 56, the logic power pattern 60, the clock signal pattern 70, and the ground pattern 66 are not formed.

In this embodiment, for example, the latch signal pattern 62, the first strobe signal pattern 64, the second strobe signal pattern 68, the first data signal patterns 72 and 72*a*, and the second data signal patterns 74 and 74*a* start from each connection terminal 28, being drawn up in the (+) direction of Y, being extended in the (+) or (−) direction of X in the region Q, being properly drawn up in the (+) direction of Y, and being extended in the (+) or (−) direction of X, to be connected to the pads corresponding thereto, respectively.

Next, a mounting of the driver IC on the thermal head substrate 20 is described. The driver IC 30 is mounted on the IC mounting portion 31 (31*a*, 31*b*, 31*c*, and 31*d* to be described later) by a flip chip bonding method. Specifically, an ACF (Anisotropic Conductive Film) is bonded over each entire area (31*a*, 31*b*, 31*c*, and 31*d*) of the IC mounting portion 31 in the thermal head substrate 20, and the driver IC 30 is mounted such that the input-output terminal bumps made of gold or solder formed on the bottom surface thereof are positioned at input-output pads corresponding to the first input-output pad array and the second input-output pad array. The ACF is compressed under high temperature to electrically conduct the input-output terminal to the input-output pad and subsequently coated with a mold resin.

In this embodiment, for example, the thermal head substrate 20 is provided with 512 heater elements 26 and 4 driver ICs 30, but the present invention is not limited thereto. The number of the heater elements 26 and the number of the driver ICs 30 may be arbitrarily extended or reduced. In addition, the terminal layout of the driver IC 30, that is, the pad layout of the IC mounting portion 31 and the layout of the connection terminal 28 are given as an example, but the present invention is not limited thereto. While the logic power pattern 60 and the clock signal pattern 70 may be only provided in the region of the IC mounting portions 31*a* to 31*d* and between the plural ground pads GND and the output pads DO1 to DO128, other portions may be arbitrarily allocated.

Hereinafter, effects and advantages of the first embodiment is described.

(1) In the above-mentioned thermal head substrate 20, a part of the logic power pattern 60 and the clock signal pattern 70 is provided to cross the IC mounting portions 31*a* to 31*d* where the driver ICs 30 are mounted, and connected to the logic power pads VDD and the clock pads CLK in the IC mounting portions 31*a* to 31*d*. For this reason, the input signal wiring pattern can be simplified, and the number of the input signal wirings which are disposed in the region (region Q) between the driver IC 30 and the connection terminal 28 can be reduced. As a result, the area of the region (region Q) between the driver IC 30 is reduced and the connection terminal 28, and thus it contributes to the miniaturization of the thermal head substrate 20.

(2) In the above-mentioned thermal head substrate 20, a part of the logic power pattern 60 and the clock signal pattern 70 is provided at the IC mounting portions 31*a* to 31*d* where the driver ICs 30 are mounted. For this reason, it is possible to widen a width of the pattern in the IC mounting portions 31*a* to 31*d*. Therefore, an noise effect is reduced, and the voltage and current drops are reduced.

(3) In the above-mentioned thermal head substrate 20, the logic power pattern 60 and the clock signal pattern 70 are provided between the plural ground pads GND and the output pads DO1 to DO128 that are formed on the IC mounting portions 31*a* to 31*d*. For this reason, the effect of noise can be reduced.

(4) In the above-mentioned thermal head substrate 20, the logic power pattern 60 is provided between the first input-output pad array of the output side of the driver IC on the side of the heater elements R1 to R512 and the clock signal pattern 70. Therefore, the clock signal pattern is separated from the first input-output pad array. Furthermore, factors that become noise to be affected are absorbed, so that it is possible to extremely reduce an effect of the clock signal pattern 70 on the first input-output pad array.

Second Embodiment

Here, the thermal head substrate according to the second embodiment is described with reference to FIGS. 7 and 8. The same components and contents as those in the first embodiment are designated by the same reference numerals and their description is omitted.

Figure 7:
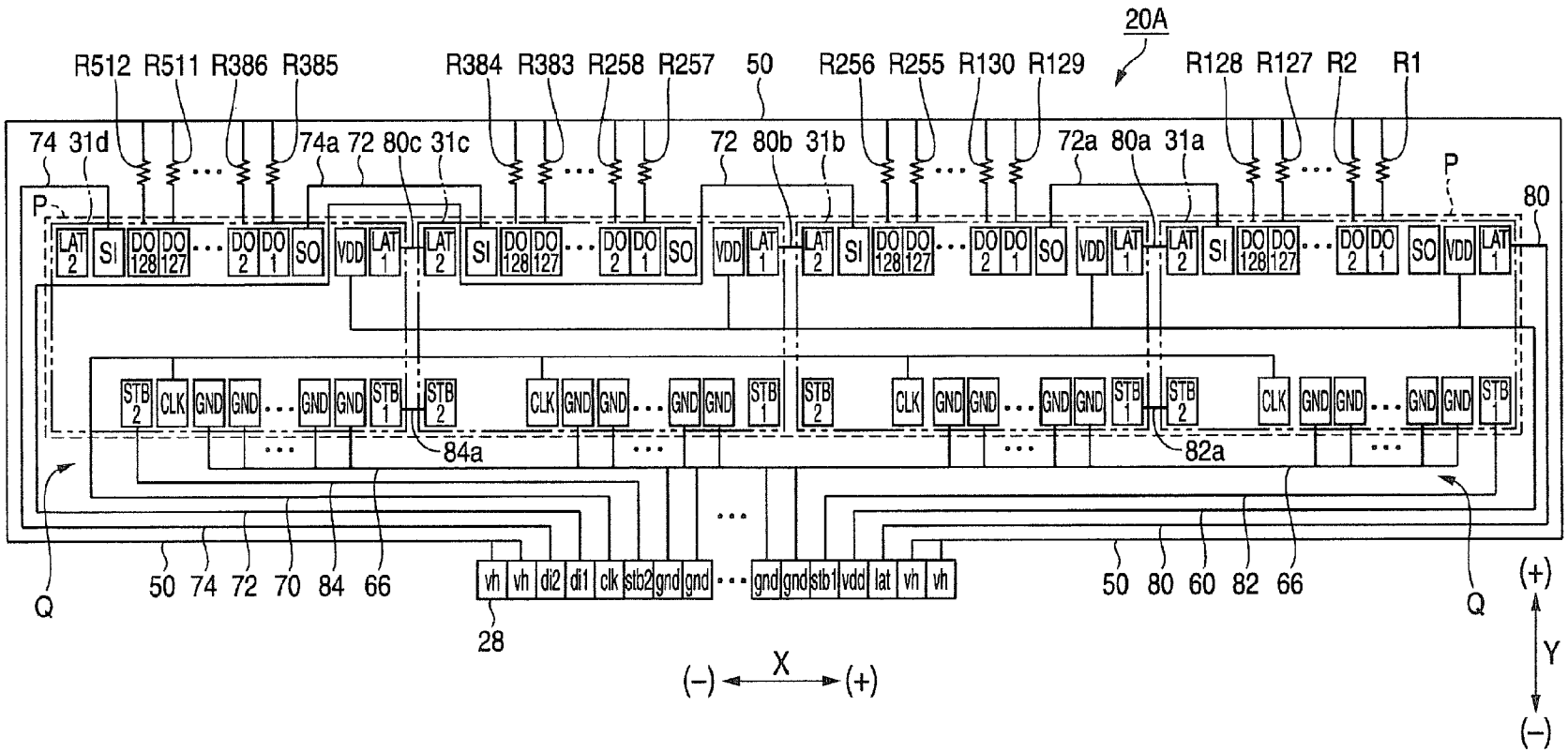
FIG. 7 is a diagram schematically illustrating a pattern of a thermal head substrate according to a second embodiment of the present invention.

As shown in FIG. 7, in the thermal head substrate 20A, a first latch pad LAT1, a logic power pad VDD, a signal-out pad SO, output pads DO1 to DO128 that are electrically conducted to 128 heater elements 26, a signal-in pad SI, and a second latch pad LAT2 in the IC mounting portion 31, where a driver IC 30A (see FIG. 8) is mounted, form a row on the side of the heater elements R1 to R512 in the order from the right of FIG. 7 (a first array). In addition, in the IC mounting portion 31, a first strobe pad STB1, five ground pads GND, a clock pad CLK, and a second strobe pad STB2 form a row on the side of the connection terminal 28 in the order from the right of FIG. 7 (a second pad array).

In the IC mounting portions 31*a* to 31*d*, the second latch pad LAT2 (an example of an output pad) of the IC mounting portion 31*a* is electrically conducted to the first latch pad LAT1 (an example of a second input pad) of the IC mounting portion 31*b* to form a first latch signal relay pattern 80*a*, the second latch pad LAT2 of the IC mounting portion 31*b* is electrically conducted to the first latch pad LAT1 of the IC mounting portion 31*c* to form a second latch signal relay pattern 80*b*, and the second latch pad LAT2 of the IC mounting portion 31*c* is electrically conducted to the first latch pad LAT1 of the IC mounting portion 31*d* to form a third latch signal relay pattern 80*c*.

In addition, the first latch pad LAT1 (an example of a first input pad) of the IC mounting portion 31*a* is electrically conducted to the latch terminal lat of the connection terminal 28 to form a latch signal pattern 80. The latch signal pattern 80 starts from the latch terminal lat, being extended in the (+) direction of X in the region Q of the thermal head substrate 20 shown in FIG. 7, being drawn up in the (+) direction of Y in the right side of the thermal head substrate 20, changing the direction in the vicinity of the first latch pad LAT1 of the IC mounting portion 31*a*, and being extended in the (−) direction of X, to be electrically conducted to the first latch pad LAT1 of the IC mounting portion 31*a*.

In the IC mounting portion 31*a* and the IC mounting portion 31*b*, the second strobe pad STB2 (an example of the output pad) of the IC mounting portion 31*a* is electrically conducted to the first strobe pad STB1 (an example of the second input pad) of the IC mounting portion 31*b* to form the strobe signal relay pattern 82*a*. In addition, the first strobe pad STB1 (an example of the first input pad) of the IC mounting portion 31*a* is electrically conducted to the first strobe terminal stb1 of the connection terminal 28 to form the first strobe signal pattern 82. The first strobe signal pattern 82 starts from the first strobe terminal stb1, being extended in the (+) direction of X in the region Q of the thermal head substrate 20 shown in FIG. 7, and being drawn up in the (+) direction of Y on the right side of the thermal head substrate 20, to be electrically conducted to the first strobe pad STB1 of the IC mounting portion 31*a*.

In the IC mounting portion 31*c* and the IC mounting portion 31*d*, the second strobe pad STB2 of the IC mounting portion 31*c* is electrically conducted to the first strobe pad STB1 of the IC mounting portion 31*d* to form the strobe signal relay pattern 84*a*. In addition, the second strobe pad STB2 of the IC mounting portion 31*d* is electrically conducted to the second strobe terminal stb2 of the connection terminal 28 to form the second strobe signal pattern 84. The second strobe signal pattern 84 starts from the second strobe terminal stb2, being extended in the (−) direction of X in the region Q of the thermal head substrate 20 shown in FIG. 7, and being drawn up in the (+) direction of Y in the left side of the thermal head substrate 20, to electrically conducted to the second strobe pad STB2 of the IC mounting portion 31*d*.

Figure 8:
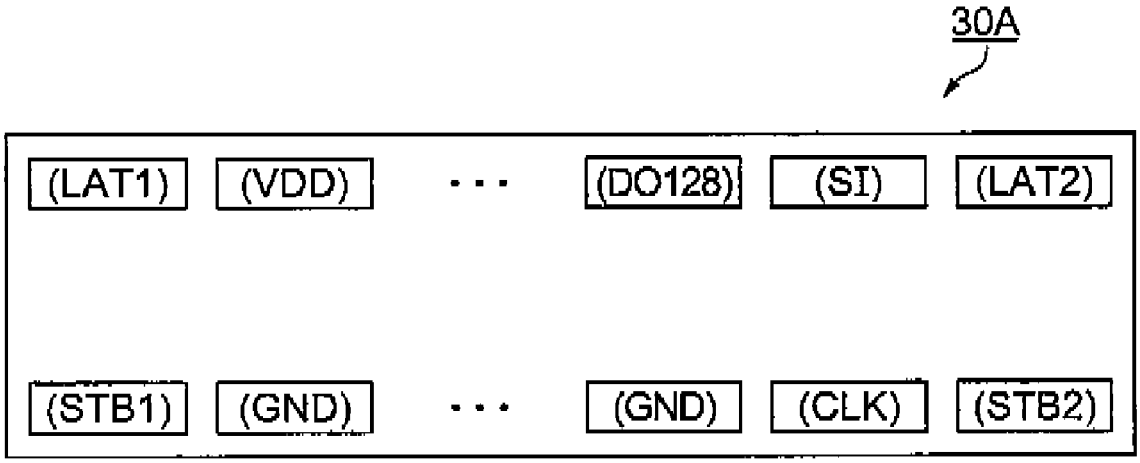
FIG. 8 is a diagram illustrating a part of input-output terminals of a driver IC according to the second embodiment of the present invention.

In the above-mentioned thermal head substrate 20A, driver ICs 30A shown in FIG. 8 are mounted on the IC mounting portions 31*a* to 31*d*, respectively. The driver IC 30A includes input-output terminals, for example, bumps made of solder or the like on the bottom thereof, which correspond to the input-output pads provided on the IC mounting portion 31. The driver IC 30A includes a first latch bump (LAT1) that corresponds to the first latch pad LAT1 and a second latch bump (LAT2) that corresponds to the second latch pad LAT2. The first latch bump (LAT1) is electrically conducted to the second latch bump (LAT2) in the IC. In addition, the first latch bump (LAT1) corresponds to an input terminal, and the second latch bump (LAT2) corresponds to an output terminal.

In addition, the driver IC 30A includes a first strobe bump (STB1) that corresponds to the first strobe pad STB1 and a second strobe bump (STB2) that corresponds to the second strobe pad STB2. The first strobe bump (STB1) is electrically conducted to the second strobe bump (STB2) in the IC. Further, in the driver ICs 30A mounted on the IC mounting portions 31*a* and 31*b*, the first strobe bump (STB1) corresponds to an input terminal and the second strobe bump (STB2) corresponds to an output terminal. In the driver ICs 30A mounted on the IC mounting portions 31*c* and 31*d*, the second strobe bump (STB2) corresponds to an input terminal and the first strobe bump (STB1) corresponds to an output terminal.

On the above-mentioned thermal head substrate 20A, the driver IC 30A is mounted. In this case, the latch signal is inputted from the latch terminal lat of the connection terminal 28, transmitted through the latch signal pattern 80 and the first latch pad LAT1 of the IC mounting portion 31*a*, inputted from the first latch bump (LAT1) of the driver IC 30A to use, and outputted from the second latch bump (LAT2). Further, in the driver IC 30A mounted on the IC mounting portion 31*b*, the latch signal is transmitted through the first latch signal relay pattern 80*a*, inputted from the first latch bump (LAT1) to use, and outputted from the second latch bump (LAT2). Also in the driver ICs 30A mounted on the IC mounting portion 31*c* and the IC mounting portion 31*d*, the latch signal is transmitted through the second latch signal relay pattern 80*b* and the third latch signal relay pattern 80*c*, inputted from the first latch bump (LAT1) to use, and outputted from the second latch bump (LAT2).

In addition, the above-mentioned strobe signal St1 is inputted from the first strobe terminal stb1 of the connection terminal 28, transmitted through the first strobe signal pattern 82 and the first strobe pad STB1 of the IC mounting portion 31*a*, inputted from the first strobe bump (STB1) of the driver IC 30A to use, and outputted from the second strobe bump (STB2). The strobe signal St1 is transmitted through the strobe signal relay pattern 82*a*, and is inputted from the first strobe bump (STB1) of the driver IC 30A which is mounted on the IC mounting portion 31*b*.

The strobe signal St2 is inputted from the second strobe terminal stb2 of the connection terminal 28, transmitted through the second strobe signal pattern 84 and the second strobe pad STB2 of the IC mounting portion 31*d*, inputted from the second strobe bump (STB2) of the driver IC 30A to use, and outputted from the first strobe bump (STB1). The strobe signal St2 is transmitted through the strobe signal relay pattern 84*a*, and is inputted from the second strobe bump (STB2) of the driver IC 30A which is mounted on the IC mounting portion 31*c*.

Hereinafter, effects and advantages of the second embodiment is described.

(1) In the above-mentioned thermal head substrate 20A, the driver ICs 30A mounted on the IC mounting portions 31*b*, 31*c*, and 31*d* supplies the latch signal to transmit through the driver IC 30A that is provided at a former stage thereof. Similarly, the driver ICs 30A mounted on the IC mounting portion 31*b* and the IC mounting portion 31*d* supplies the strobe signals St1 and St2 to transmit through the driver IC 30A that is provided at a former stage thereof. Therefore, the latch signal pattern 80, the first strobe signal pattern 82, and the second strobe signal pattern 84 can be simplified, and it is possible to reduce the number of wirings of the input signal wiring patterns that are disposed in the region (region Q) between the driver IC 30A and the connection terminal 28. As a result, it is possible to reduce the area of the region (region Q) between the driver IC 30A and the connection terminal 28, and thus it can contribute to the miniaturization of the thermal head substrate 20A.

(2) The thermal head that mounts the above-mentioned thermal head substrate 20A transmits the latch signal and the strobe signals St1 and St2 by using the signal lines in the driver IC 30A. The signal lines in the driver IC 30A can be increased in current capacity compared with the input signal wiring patterns provided on the substrate. Therefore, the noise effect is reduced, and further the voltage and current drops are reduced.

Third Embodiment

Figure 9:
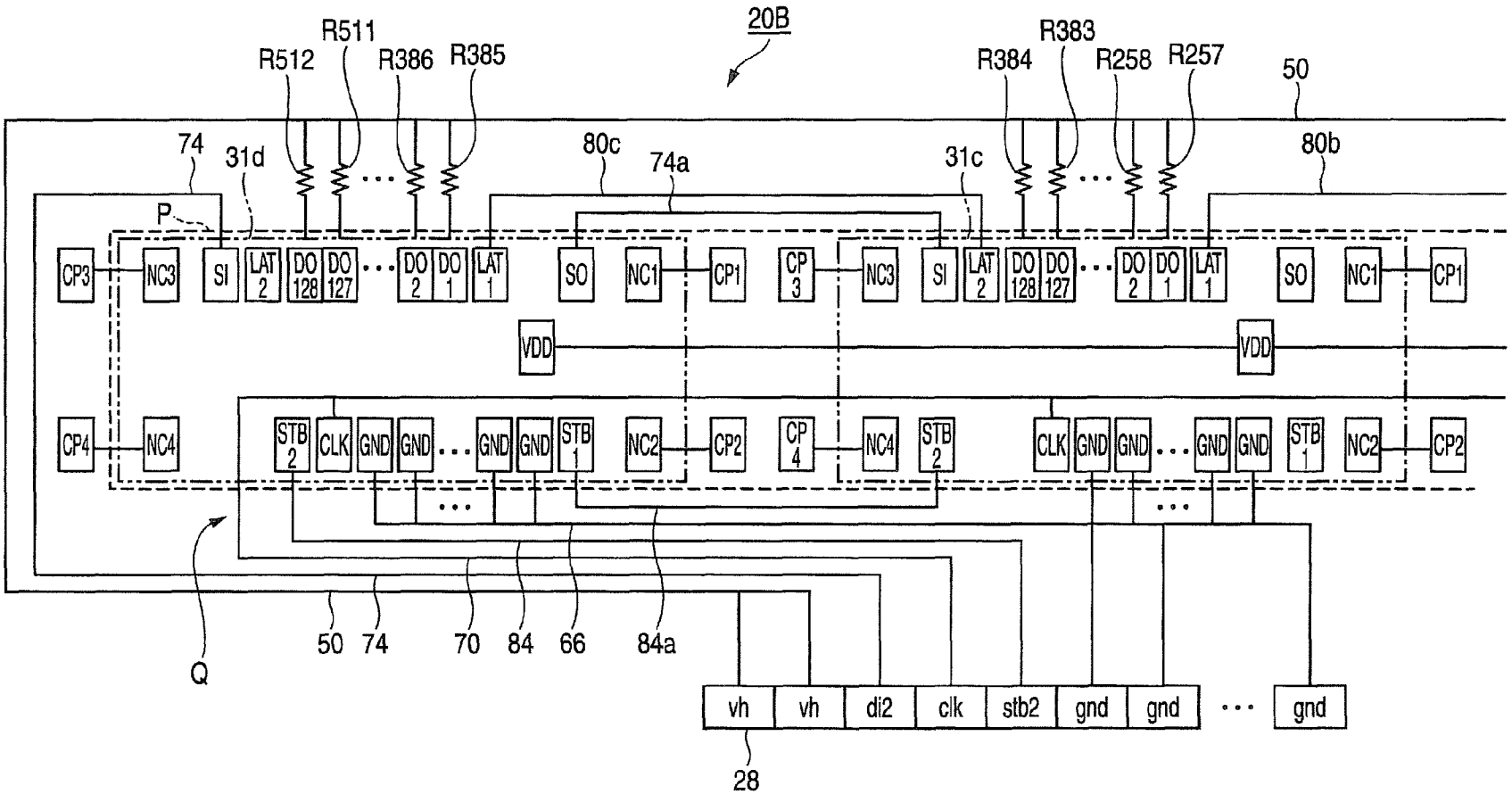
FIGS. 9(*a*) and 9(*b*) are diagrams schematically illustrating a pattern of a thermal head substrate according to a third embodiment of the present invention.
Figure 9:
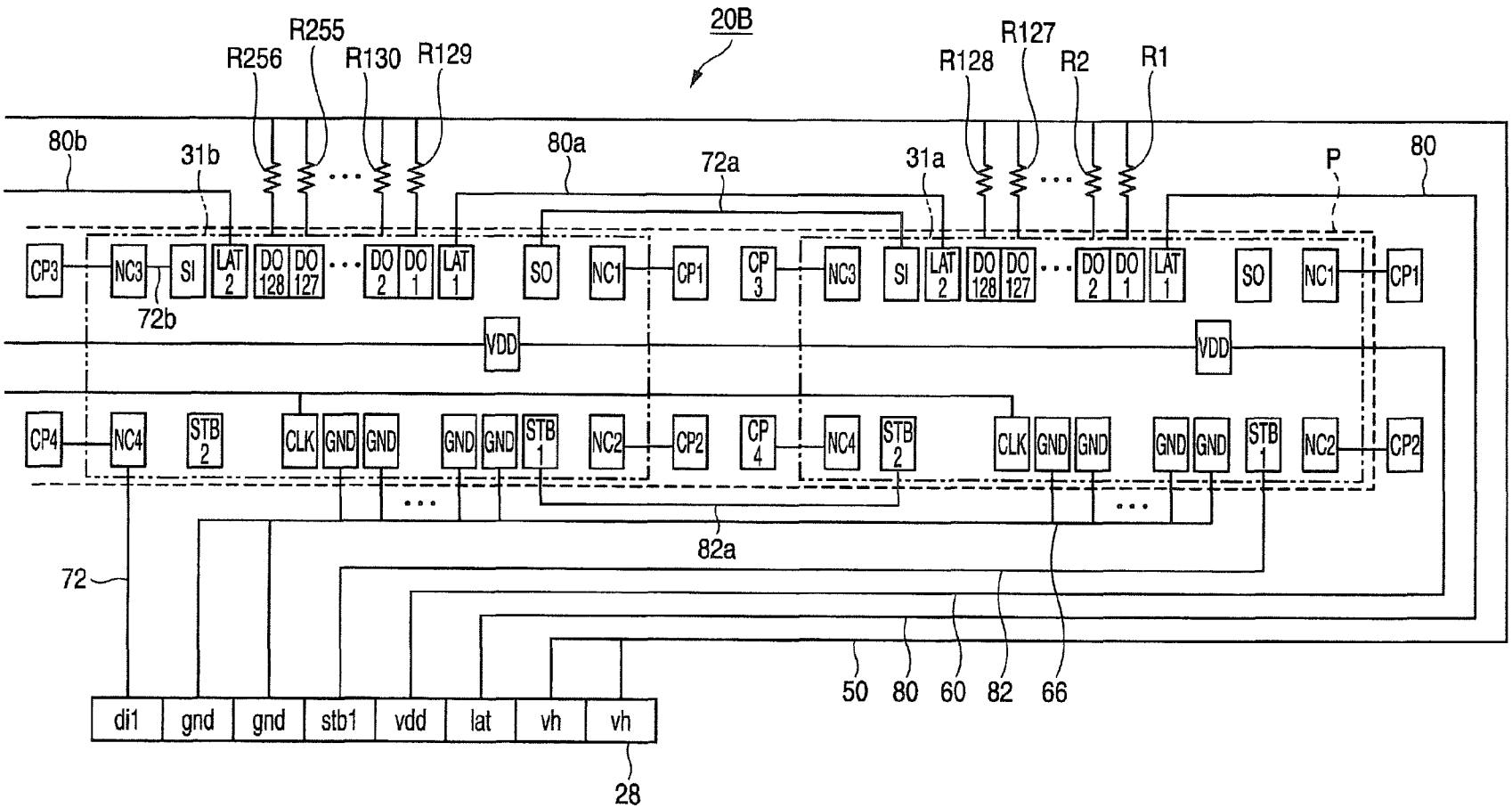

The thermal head substrate according to the third embodiment will be described with reference to FIGS. 9(*a*), 9(*b*) and 10. FIG. 9(*a*) shows a pattern layout relating to the IC mounting portions 31*c* and 31*d*, and FIG. 9(*b*) shows a pattern layout relating to the IC mounting portions 31*a* and 31*b*. The same components and contents as those in the second embodiment are designated by the same reference numerals and the description thereof is omitted.

As shown in FIGS. 9(*a*) and 9(*b*), in a thermal head substrate 20B, a first non-connected pad NC1, a signal-out pad SO, a first latch pad LAT1, output pads DO1 to DO128 that are electrically conducted to 128 heater elements 26, a second latch pad LAT2, a signal-in pad SI, and a third non-connected pad NC3 are provided in the IC mounting portion 31, where a driver IC 30B (see FIG. 10) is mounted, form a row on the side of the heater elements R1 to R512 in the order from the right of FIG. 9(*b*) (a first pad array). In addition, in the IC mounting portion 31, a second non-connected pad NC2, a first strobe pad STB1, five ground pads GND, a clock pad CLK, a second strobe pad STB2, and a fourth non-connected pad NC4 form a row on the side of the connection terminal 28 in the order from the right of FIG. 9(*b*) (a second pad array). Further, a logic power pad VDD (an example of an input pad) is disposed between the first input-output pad array including output pads DO1 to DO128 and the second input-output pad array including plural ground pads GND.

In addition, check pads (extension pads) CP1 to CP4 that are electrically conducted to the above-mentioned non-connected pads NC1 to NC4, respectively, are disposed in the outside region of the IC mounting portion 31.

In the IC mounting portions 31*a* to 31*d*, the second latch pad LAT2 of the IC mounting portion 31*a* is electrically conducted to the first latch pad LAT1 of the IC mounting portion 31*b* to form a first latch signal relay pattern 80*a*, the second latch pad LAT2 of the IC mounting portion 31*b* is electrically conducted to the first latch pad LAT1 of the IC mounting portion 31*c* to form a second latch signal relay pattern 80*b*, and the second latch pad LAT2 of the IC mounting portion 31*c* is electrically conducted to the first latch pad LAT1 of the IC mounting portion 31*d* to form a third latch signal relay pattern 80*c*.

In addition, the first latch pad LAT1 of the IC mounting portion 31*a* is electrically conducted to the latch terminal lat of the connection terminal 28 to form a latch signal pattern 80.

In the IC mounting portion 31*a* and the IC mounting portion 31*b*, the second strobe pad STB2 of the IC mounting portion 31*a* is electrically conducted to the first strobe pad STB1 of the IC mounting portion 31*b* to form the strobe signal relay pattern 82*a*. In addition, the first strobe pad STB1 of the IC mounting portion 31*a* is electrically conducted to the first strobe terminal stb1 of the connection terminal 28 to form the first strobe signal pattern 82.

In the IC mounting portion 31*c* and the IC mounting portion 31*d*, the second strobe pad STB2 of the IC mounting portion 31*c* is electrically conducted to the first strobe pad STB1 of the IC mounting portion 31*d* to form the strobe signal relay pattern 84*a*. In addition, the second strobe pad STB2 of the IC mounting portion 31*d* is electrically conducted to the second strobe terminal stb2 of the connection terminal 28 to form the second strobe signal pattern 84.

Figure 10:
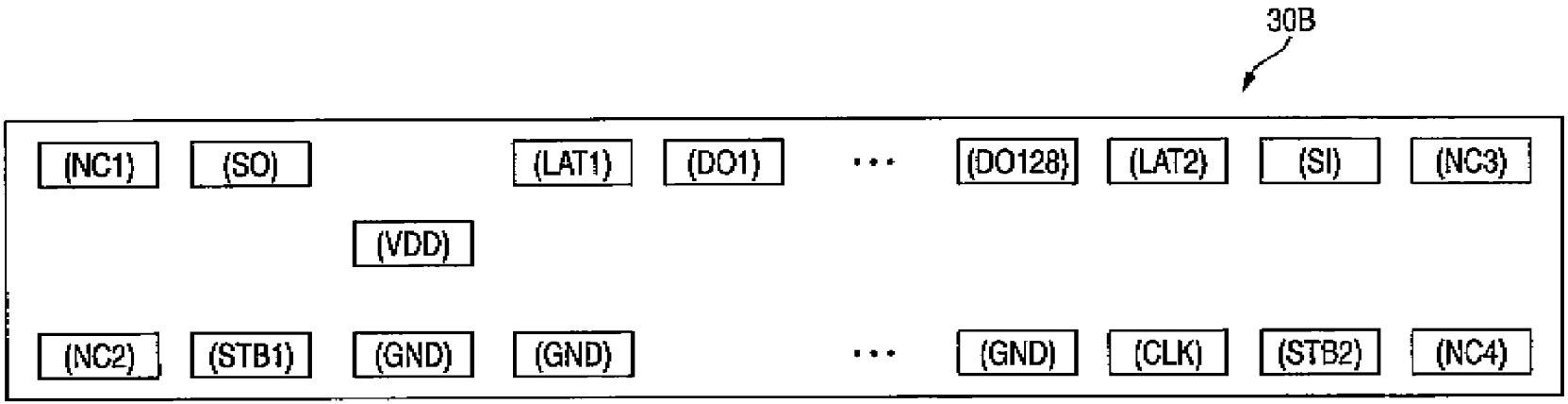
FIG. 10 is a diagram illustrating a part of input-output terminals of a driver IC according to the third embodiment.

In the above-mentioned thermal head substrate 20B, driver ICs 30B shown in FIG. 10 are mounted on the IC mounting portions 31*a* to 31*d*, respectively. The driver IC 30B includes input-output terminals, for example, bumps made of solder or the like on the bottom thereof, which correspond to the input-output pads provided on the IC mounting portion 31. The driver IC 30B includes a first latch bump (LAT1) that corresponds to the first latch pad LAT1 and a second latch bump (LAT2) that corresponds to the second latch pad LAT2. The first latch bump (LAT1) is electrically conducted to the second latch bump (LAT2) in the IC. In addition, the first latch bump (LAT1) corresponds to an input terminal, and the second latch bump (LAT2) corresponds to an output terminal.

In addition, the driver IC 30B includes a first strobe bump (STB1) that corresponds to the first strobe pad STB1 and a second strobe bump (STB2) that corresponds to the second strobe pad STB2. The first strobe bump (STB1) is electrically conducted to the second strobe bump (STB2) in the IC. Further, in the driver ICs 30B to be mounted on the IC mounting portions 31*a* and 31*b*, the first strobe bump (STB1) corresponds to an input terminal, and the second strobe bump (STB2) corresponds to an output terminal. In the driver ICs SOB to be mounted on the IC mounting portions 31*c* and 31*d*, the second strobe bump (STB2) corresponds to an input terminal, and the first strobe bump (STB1) corresponds to an output terminal.

Further, the driver IC 30B includes a first non-connected bump (NC1) (an example of a first terminal) that corresponds to the first non-connected pad NC1 (an example of a first extension pad), a second non-connected bump (NC2) (an example of a second terminal) that corresponds to the second non-connected pad NC2 (an example of a second extension pad), a third non-connected bump (NC3) (an example of the first terminal) that corresponds to the third non-connected pad NC3 (an example of the first extension pad), and a fourth non-connected bump (NC4) (an example of a second terminal) that corresponds to the fourth non-connected pad NC4 (an example of the second extension pad). The first non-connected bump (NC1) is electrically conducted to the second non-connected bump (NC2) in the IC, and the third non-connected bump (NC3) is electrically conducted to the fourth non-connected bump (NC4) in the IC.

On the above-mentioned thermal head substrate 20B, the driver IC 30B is mounted. In this case, the latch signal is inputted from the latch terminal lat of the connection terminal 28, transmitted through the latch signal pattern 80 and the first latch pad LAT1 of the IC mounting portion 31*a*, inputted from the first latch bump (LAT1) of the driver IC 30B to use, and outputted from the second latch bump (LAT2). Further, in the driver IC 30B mounted on the IC mounting portion Sib, the latch signal is transmitted through the first latch signal relay pattern 80*a*, inputted from the first latch bump (LAT1) to use, and outputted from the second latch bump (LAT2). Also in the driver ICs SOB mounted on the IC mounting portion 31*c* and the IC mounting portion 31*d*, the latch signal is transmitted through the second latch signal relay pattern 80*b* and the third latch signal relay pattern 80*c*, inputted from the first latch bump (LAT1) to use, and outputted from the second latch bump (LAT2).

In addition, the above-mentioned strobe signal St1 is inputted from the first strobe terminal stb1 of the connection terminal 28, transmitted through the first strobe signal pattern 82 and the first strobe pad STB1 of the IC mounting portion 31*a*, inputted from the first strobe bump (STB1) of the driver IC 30B to use, and outputted from the second strobe bump (STB2). The strobe signal St1 is transmitted through the strobe signal relay pattern 82*a*, and is inputted from the first strobe bump (STB1) of the driver IC 30B that is mounted on the IC mounting portion 31*b*.

The strobe signal St2 is inputted from the second strobe terminal stb2 of the connection terminal 28, transmitted through the second strobe signal pattern 84 and the second strobe pad STB2 of the IC mounting portion 31*d*, inputted from the second strobe bump (STB2) of the driver IC 30B to use, and outputted from the first strobe bump (STB1). The strobe signal St2 passes through the strobe signal relay pattern 84*a*, and is inputted from the second strobe bump (STB2) of the driver IC 30B that is mounted on the IC mounting portion 31*c*.

The first data signal pattern 72 is extended from the first data terminal di1 of the connection terminal 28, and the first data signal pattern 72 is electrically conducted to the fourth non-connected pad NC4 of the IC mounting portion 31*b*. The fourth non-connected pad NC4 is electrically conducted to the third non-connected pad NC3 through the signal line in the driver IC 30B, and electrically conducted to the signal-in pad SI by the first data signal pattern 72*b*. The signal-out pad SO of the IC mounting portion 31*b* is electrically conducted to the signal-in pad SI of the IC mounting portion 31*a* by the first data signal pattern 72*a*. The second data signal pattern 74 is extended from the second data terminal di2 of the connection terminal 28, and the second data signal pattern 74 is electrically conducted to the signal-in pad SI of the IC mounting portion 31*d*. The signal-out pad SO of the IC mounting portion 31*d* is electrically conducted to the signal-in pad SI of the IC mounting portion 31*c* by the second data signal pattern 74*a*.

Hereinafter, effects and advantages of the third embodiment is described.

(1) In the above-mentioned thermal head substrate 20B, the driver ICs 30B mounted on the IC mounting portions 31*a* to 31*d* are bonded with pressure to the signal pads via an ACF (Anisotropic Conductive Film) therebetween by using a flip chip bonding method. Therefore, a contact state of the pads cannot be confirmed externally. However, it is possible to determine whether or not the contact state of the pads is proper by placing probe terminals of a resistance measuring equipment on the check pads CP1 (CP3) and CP2 (CP4) on the thermal head substrate 20B and measuring a connection resistance value between the pads. For example, the probe terminals of the resistance measuring equipment are placed on the check pad (the first extension pad) CP1 that is electrically conducted to the first non-connected pad NC1 and the check pad (the second extension pad) CP2 that is electrically conducted to the second non-connected pad NC2 and measures the resistance value thereof. Therefore, it is possible to measure the connection resistance between the first non-connected pad NC1 of the thermal head substrate 20B and the first non-connected bump (NC1) of the driver IC 30B and the connection resistance between the second non-connected pad NC2 and the second non-connected bump (NC2) of the driver IC 30B. Similarly, the connection resistance between the bumps of both ends of the driver ICs and the pads of the thermal head substrate can be measured by using other check pads CP3 and CP4. When the resistance value is higher than it is expected to be, it is determined that the contact state is not good, and when it is an open state, it is determined that there is no junction. Therefore, it is possible to detect a contact fault, which contributes to quality management.

In addition, as another checking method, it is possible to determine a current-voltage characteristic by flowing a weak current through the similarly probe terminals that is placed on the above-mentioned check pads CP, and by measuring a voltage when the current is changed. Therefore, the detailed contact state is checked, and it contributes to further sophisticated quality management.

(2) The driver IC 30B mounted on the IC mounting portion 31*b* can supply a signal from the first data terminal di1 of the connection terminal 28 to the signal-in pad SI to transmit through the driver IC 30B through the fourth non-connected pad NC4 and the third non-connected pad NC3. For this reason, the first data signal pattern 72 is simplified, and it reduces the number of wirings of the signal wiring patterns that are disposed in the region (region Q) between the driver IC 30B and the connection terminal 28 and in the region within the IC mounting portions 31*c* and 31*d*. As a result, the area of the region (region Q) between the driver IC 30B and the connection terminal 28 is reduced, and thus contributes to the miniaturization of the thermal head substrate 20B. Further, a width of the wiring pattern of the logic power pattern 60 or the clock signal pattern 70 that is disposed in the IC mounting portions 31*c* and 31*d* is widened, and thus reduces the noise effect, and reduces the voltage and current drop.

(3) In the driver ICs BOB mounted on the IC mounting portions 31*a* to 31*d*, since the logic power pad VDD is disposed on the logic power pattern 60, which is disposed between the first input-output pad array including the output pads DO1 to DO128 and the second input-output pad array including the plural ground pads GND, the connection patterns are simplified by the reduction of meanderings or branches of the logic power pattern 60. Consequently, the noise effect is also reduced.

Modified Example

In the above-mentioned third embodiment, the logic power pad VDD is disposed between the first input-output pad array including the output pads DO1 to DO128 and the second input-output pad array including the plural ground pads GND. However, the clock pad CLK may be disposed between the first input-output pad array and the second input-output pad array. In this case, the same effects are achieved.

Fourth Embodiment

Figure 11:
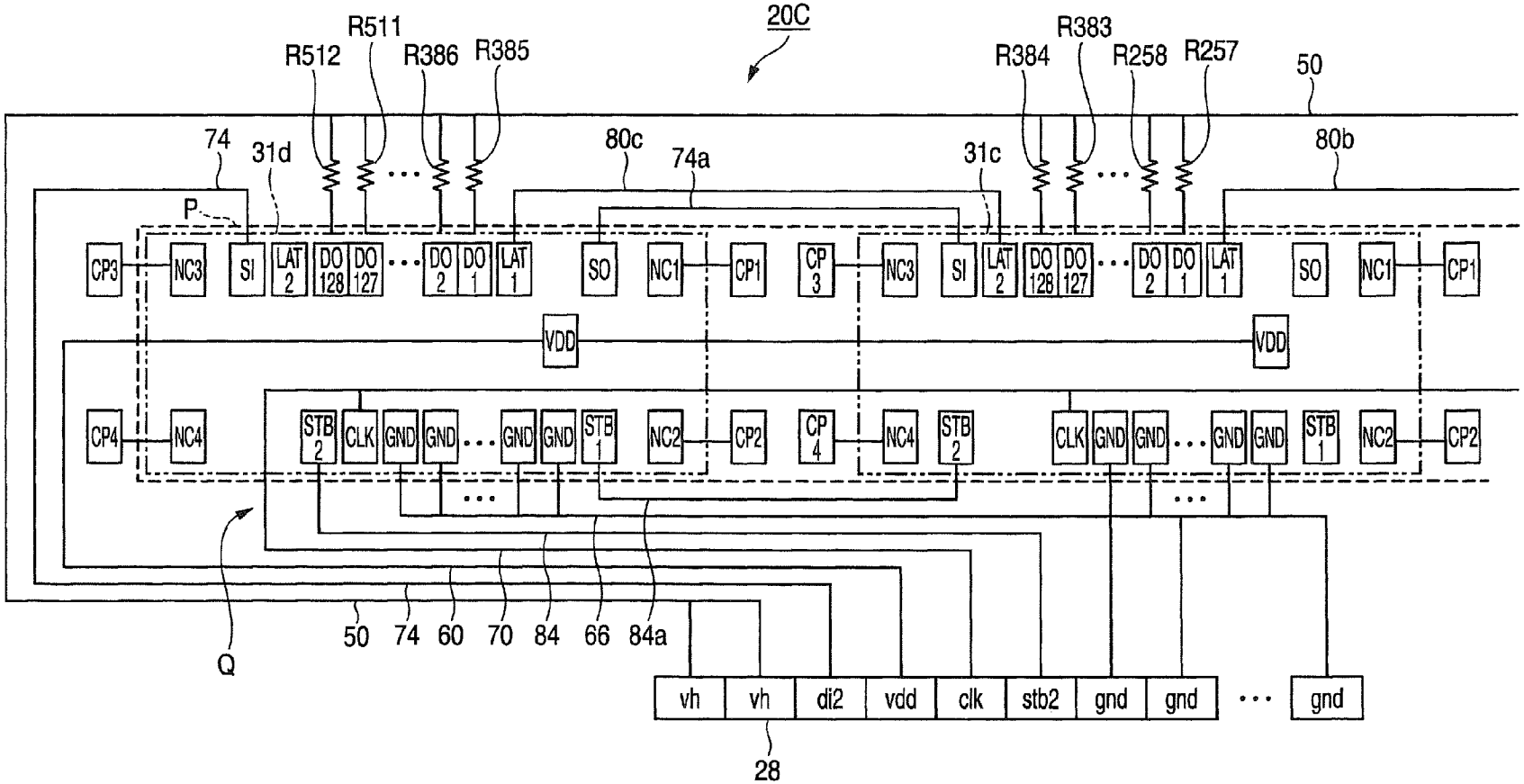
FIGS. 11(*a*) and 11(*b*) are diagram schematically illustrating a pattern of a thermal head substrate according to a fourth embodiment of the present invention.
Figure 11:
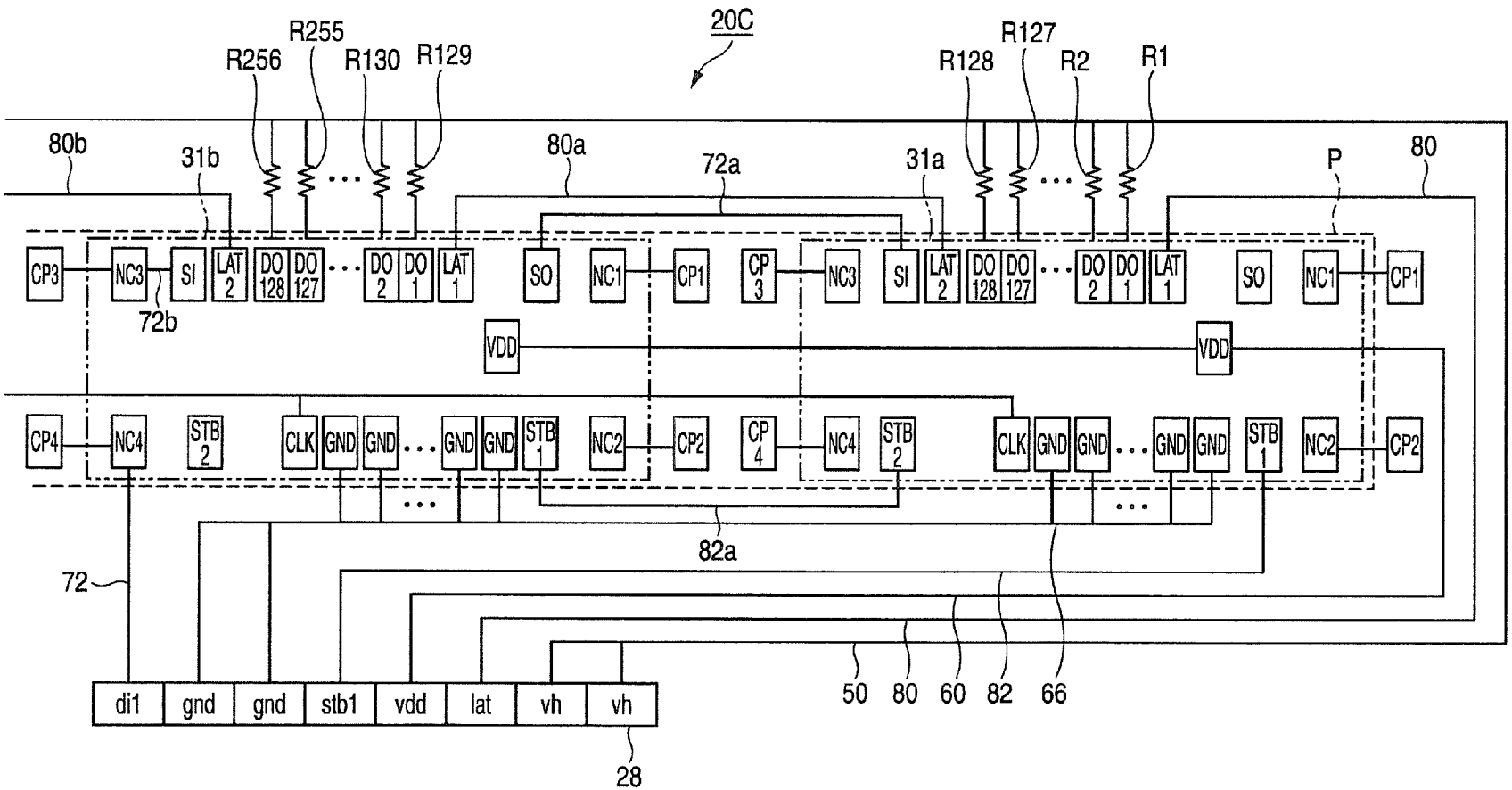

The thermal head substrate according to the fourth embodiment is described with reference to FIGS. 11(*a*) and 11(*b*). FIG. 11(*a*) shows a pattern layout relating to the IC mounting portions 31*c* and 31*d*, and FIG. 11(*b*) shows a pattern layout relating to the IC mounting portions 31*a* and 31*b*.

As shown in FIGS. 11(*a*) and 11(*b*), in the thermal head substrate 20, the wiring pattern of the logic power is connected to the logic power pad VDD of the driver IC from both ends of the head substrate in the longitudinal direction. Specifically, as shown in FIG. 11(*a*), the logic power terminal vdd (an example of a first contact) of the connection terminal 28, the logic power pad VDD (an example of a first input pad) of the IC mounting portion 31*d*, and the logic power pad VDD (an example of the first input pad) of the IC mounting portion 31*c* are electrically conducted by the logic power pattern 60 (an example of a first logic power line). Further, as shown in FIG. 11(*b*), the logic power terminal vdd (an example of a second contact) of the connection terminal 28, the logic power pad VDD (an example of a second input pad) of the IC mounting portion 31*a*, and the logic power pad VDD (an example of the second input pad) of the IC mounting portion 31*b* are electrically conducted by the logic power pattern 60 (an example of a second logic power line).

Hereinafter, effects and advantages of the fourth embodiment is described.

In the above-mentioned thermal head substrate 20C, the logic power line connected to the plural driver ICs is supplied by the wiring pattern that is extended from both ends of the substrate. Therefore, compared with the case where the logic power is supplied by the conventional wiring pattern from just one direction, a loss in power by the resistance of the wiring pattern is reduced, and thus contributes to supplying a stable logic power with a low voltage drop to the driver IC.

In addition, the present invention is not limited to the above-mentioned embodiments, and various changes can be made. For example, in the above-mentioned embodiments, the input pad and the output pad of the latch signal are disposed on the first input-output pad array and the input pad and the output pad of the strobe signal are disposed on the second input-output pad array of the mounting region. However, each pad of the latch signals may be provided on the first input-output pad array, and each pad of the latch signals may be provided on the second input-output pad array. In addition, the input pad and the output pad of the latch signal and the strobe signal may be provided on the first input-output pad array such that the input pad of the strobe signal is provided close to the left side of the input pad LAT1 of the latch signal of the first input-output pad array, and the output pad of the strobe signal is provided close to the right side of the output pad LAT2 of the latch signal. Further, the input pad and the output pad of the latch signal and the strobe signal are provided on the second input-output pad array instead of the first input-output pad array. At this time, it may be unnecessary to arrange the latch signal and the strobe signal in this order from the end. However, as shown in FIG. 7, the reason that the input pad and the output pad are arranged in a left-right symmetric fashion is because the wiring pattern is simplified only by connecting the adjacent pads to each other that are located on the end of the mounting region.

In addition, in the embodiment, as a non-connected portion, the non-connected pads NC1 to NC4 were described as an illustrative example. It may be provided only with the non-connected pads NC1 and NC2. It is preferable that the non-connected pads are provided at both ends of the driver IC in the longitudinal direction for checking that the driver IC is surely mounted on the substrate without inclination.

In addition, in the embodiments, the thermal head substrate provided on the thermal printer which is mounted on an electronic device is explained as an example. However, the present invention is not limited to the embodiments. That is, the present invention can be applied to a head substrate provided in a liquid ejecting apparatus such as an ink jet printer. As driving elements provided in the liquid ejecting apparatus, various types of elements such as heater elements or piezoelectric elements can be employed. In addition, the present invention can be applied to a head substrate provided in an image forming apparatus such as an LED printer. As driving elements provided in the liquid ejecting apparatus, an LED array can be employed. Further, these types of elements may be formed on the head substrate according to the present invention or on another substrate. In a case where the driving elements are formed on another substrate, the driving elements are electrically connected to the driver IC which is mounted on the head substrate according to the present invention via one or more output signal wiring.

What is claimed is:

1. A head substrate on which a plurality of driver ICs are to be mounted, the driver ICs selectively driving a plurality of driving elements which are formed on the head substrate in a row, the head substrate comprising:

a plurality of external connection terminals including a plurality of contacts to which a clock signal and a logic power for the driver ICs are supplied;

a plurality of first pad arrays and a plurality of second pad arrays wherein each of the first pad arrays includes a plurality of pads formed at one side in regions on which the driver ICs are respectively mounted and each of the second pad arrays includes a plurality of pads formed at another side in the regions on which the driver ICs are respectively mounted, the pads of each of the first pad arrays including output pads which are connected to terminals provided on each of the driver ICs and outputs driving signals to the driving elements, the pads of each of the second pad arrays including ground pads which are connected to terminals provided on each of the driver ICs and ground each of the driver ICs; and an input signal wiring pattern electrically connecting the external connection terminals with the pads in the first pad arrays and the second pad arrays;

wherein the input signal wiring pattern includes a clock signal line connected to a plurality of clock pads for supplying the clock signal to the driver ICs and a logic power line connected to a plurality of logic power pads for supplying the logic power to the driver ICs;

wherein an entirety of the clock signal line that connects the clock pads in adjacent regions on which adjacent driver ICs are mounted is disposed between the first pad arrays and the second pad arrays of the adjacent regions; and wherein an entirety of the logic power line that connects the logic power pads in adjacent regions on which adjacent driver ICs are mounted is disposed between the first pad arrays and the second pad arrays of the adjacent regions.

2. The head substrate as set forth in claim 1, wherein the logic power line is disposed between the first pad arrays and the clock signal line.

3. The head substrate as set forth in claim 1, wherein the driver ICs can be mounted on the head substrate in parallel with the driving elements.

4. The head substrate as set forth in claim 3, wherein the external connection terminals include a contact to which one of a latch signal and a strobe signal is supplied;

wherein the pads in the first pad arrays and the second pad arrays include a first input pad at one side of a region on which one of the driver ICs is mounted and an output pad at another side of the region and a second input pad at one side of a region on which another of the driver ICs is mounted; and wherein the input signal wiring pattern electrically connects the contact with the first input pad and connects the output pad with the second input pad.

5. The head substrate as set forth in claim 1, wherein at least one of the first pad arrays and the second pad arrays includes a first extension pad that is connected to a first terminal provided on one of the driver ICs and a second extension pad that is connected to a second terminal provided on the one of the driver ICs when the first terminal and the second terminal are electrically connected with each other; and wherein the first extension pad and the second extension pad are extended to the outside of one of the regions on which the one of the driver ICs is mounted.

6. The head substrate as set forth in claim 5, wherein the input signal wiring pattern electrically connects the second extension pad with one of the external connection terminals.

7. The head substrate as set forth in claim 1, further comprising an input pad that is disposed between the first pad arrays and the second pad arrays and is connected to a terminal provided on one of the driver ICs, wherein the clock signal line electrically connects the input pad to one of the contacts, to which the clock signal for the one of the driver ICs is supplied.

8. The head substrate as set forth in claim 1, further comprising an input pad which is disposed between the first pad arrays and the second pad arrays and is connected to a terminal provided on one of the driver ICs, wherein the logic power line electrically connects the input pad to one of the contacts, to which the logic power for the one of the driver ICs is supplied.

9. The head substrate as set forth in claim 1, further comprising a first input pad that is connected to a terminal provided on one of the driver ICs and a second input pad which are connected to a terminal provided on another of the driver ICs;

wherein the first input pad and the second input pad are disposed between the first pad arrays and the second pad arrays;

wherein the external connection terminals include a first contact and a second contact to which the logic power for the driver ICs is supplied;

wherein the logic power line includes a first logic power line and a second power line; and wherein the first logic power line electrically connects the first input pad with the first contact and the second logic power line electrically connects the second input pad with the second contact.

10. A method for mounting a plurality of driver ICs on a head substrate, comprising:

providing the head substrate as set forth in claim 1; and mounting the driver ICs on the head substrate via an anisotropic conductive film by a flip chip bonding method.

11. A thermal head substrate, comprising:

a substrate which is formed into a rectangle shape;

a wiring pattern which is formed on the substrate from a plurality of heater elements disposed in a row at a side of one long side of the substrate to mounting regions of a plurality of driver ICs which selectively heats the heater elements; and a signal wiring pattern formed on the substrate to make a conduction between an external connection terminal portion formed at another long side of the substrate and input and output portions for a control signal of the driver ICs and make a signal connection between the driver ICs;

wherein first pads are formed in a row in the mounting regions of the driver ICs at a side of the heater elements, the first pads including a plurality of output pads of a plurality of heater driving signals, which are connected to first terminals provided in the driver ICs;

wherein second pads are formed in a row at a side of the external connection terminal portion, the second pads including a plurality of ground pads which are electrically connected to the signal wiring pattern and connected to second terminals formed in the driver ICs;

wherein an entirety of a clock signal line that connects two clock pads disposed in adjacent mounting regions on which adjacent driver ICs are mounted is formed between the row of the first pads including the output pads of the heater driving signals and the row of the second pads including the ground pads; and wherein an entirety of a logic power line that connects two logic power pads disposed in the adjacent mounting regions on which the adjacent driver ICs are mounted is formed between the row of the first pads including the output pads of the heater driving signals and the row of the second pads including the ground pads.

* * * * *